United States Patent [19]

Smith, Jr. et al.

[11] Patent Number: 4,603,464

[45] Date of Patent: Aug. 5, 1986

[54] STAND JUMPING AND STABBING GUIDE DEVICE AND METHOD

[75] Inventors: Roger Smith, Jr., Georgetown; Harry D. Hebard, Burnet, both of Tex.

[73] Assignee: Hughes Tool Company, Houston, Tex.

[21] Appl. No.: 710,730

[22] Filed: Mar. 11, 1985

[51] Int. Cl.[4] ..... B21D 39/03

[52] U.S. Cl. ..... 29/428; 81/57.16; 81/57.34; 81/429

[58] Field of Search ..... 81/57.16, 57.22, 57.24, 81/57.34, 57.35, 429; 29/428

[56] References Cited

U.S. PATENT DOCUMENTS

| | | | |
|---|---|---|---|
| 2,784,626 | 3/1957 | Paget | 81/53 |
| 2,969,702 | 1/1961 | Cornish et al. | 81/53 |
| 3,722,603 | 3/1973 | Brown | 81/57.16 |
| 4,023,449 | 5/1977 | Boyadjieff | 81/57.35 |
| 4,348,920 | 9/1982 | Boyadjieff | 81/57.16 |

*Primary Examiner*—James L. Jones, Jr.
*Attorney, Agent, or Firm*—H. Dennis Kelly

[57] ABSTRACT

A well tool and method for making up and breaking out connections between sections of drill pipe. The tool will jump the upper pipe section out of the connection when the connection has been completely unthreaded, and will guide the upper pipe section during stabbing. A piston and cylinder assembly is mounted on the carriage for raising and lowering the pipe spinner relative to the carriage. The tool also has an actuator and a pilot valve for automatically opening the clamping cylinders of the spinner whenever the upper pipe section is raised by the pipe elevator.

7 Claims, 3 Drawing Figures

STAND JUMPING AND STABBING GUIDE DEVICE AND METHOD

BACKGROUND OF THE INVENTION

1. Field of the Invention

This invention relates in general to well tools and methods for making and breaking threaded connections in a well pipe. In particular, the invention relates to a device which will jump the upper pipe section out of the connection, when the connection has been unthreaded, and will guide the upper pipe section during a stabbing operation.

2. Description of the Prior Art

This invention is basically an improvement of the device and method described in U.S. Pat. No. 4,348,920 (Boyadjieff), issued Sept. 14, 1982. That device is a power driven tool for making and breaking threaded connections between well pipe sections. The tool includes a movable carriage, a well pipe spinner, and a torque wrench assembly. The torque wrench assembly consists of a pair of wrenches, which are used to make and break connections between the tool joints on upper and lower pipe sections. The spinner is used to rotate the upper pipe section rapidly into or out of connection with the lower pipe section.

The upper pipe section may be part of a pipe stand consisting of two or more pipe sections. During making or breaking operations, the pipe stand is usually supported by an elevator, which is suspended from a derrick hook. The hook has a biasing device, such as a spring, for jumping the upper pipe section out of the connection, once the connection has been completely unthreaded. However, there are some situations, such as on offshore drilling rigs, where the hook is not sufficient to jump the pipe stand out of the connection. On offshore rigs, the motion compensator is inactive while a connection is being made up or broken at the rotary table, so the stand jumper must contend with the acceleration forces on the stand due to heave. Another situation in which a hook is insufficient is when drill collar stands are being disconnected, because drill collar stands are much heavier than drill pipe.

The spinner described in U.S. Pat. No. 4,348,920 (Boyadjieff), is mounted on springs to compensate for the vertical movement of the upper pipe section as the upper pipe section is threaded into or out of the lower pipe section. The springs are not, however, strong enough to jump the upper pipe section out of the connection. The springs are only strong enough to counterbalance or support the weight of the spinner.

SUMMARY OF THE INVENTION

The well tool of the invention will exert lift on a stand of pipe while a joint is being spun out, and then continue to lift the stand until the end of the pin is well clear of the box shoulder, to prevent damage to the joint. The invention may also be used to guide the upper pipe section during a stabbing operation.

The well tool of the invention has a carriage, a pipe spinner, and a torque wrench assembly. The well tool also has a piston and cylinder assembly for raising and lowering the spinner relative to the carriage. Thus, when the upper pipe has been disconnected from the lower pipe section, the hydraulic piston and cylinder assembly raises the spinner to jump the upper pipe section out of the connection.

The well tool also automatically opens the clamping cylinders of the spinner whenever the upper pipe section is raised and the spinner is moved upward relative to the piston and cylinder assembly. When the pipe stand is lifted by the elevator, the spinner will thus automatically release the upper pipe section.

The above, as well as additional objects, features, and advantages of the invention, will become apparent in the following detailed description.

DESCRIPTION OF THE PREFERRED EMBODIMENT

Figure 1:
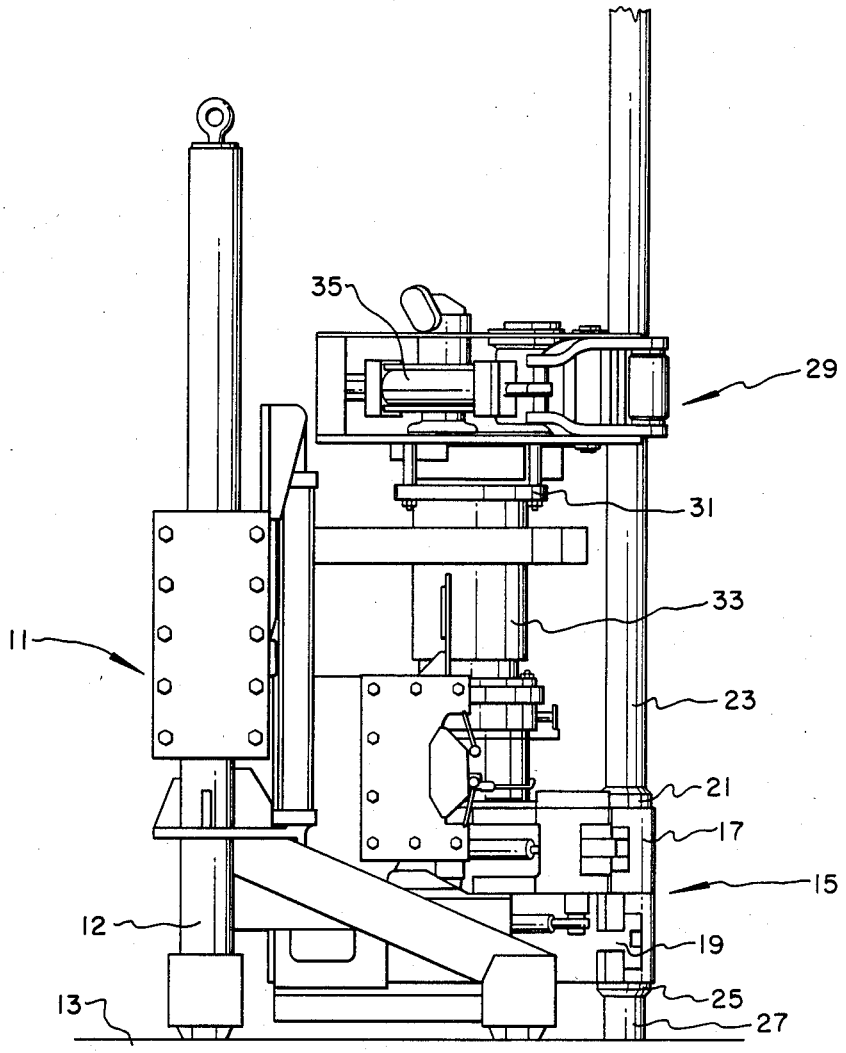
FIG. 1 is a side view of a well tool of the invention.

The well tool of the invention, illustrated in FIG. 1, has a carriage 11, which is vertically movable on a frame 12. The frame 12 moves across the rig floor along a track 13. A torque wrench assembly 15 is mounted on the carriage 11, and consists of an upper wrench 17 and a lower wrench 19. The upper wrench 17 is adapted to grip and apply torque in either direction to a tool joint 21 on an upper pipe section 23. The lower wrench 19 is adapted to grip a tool joint 25 on a lower pipe section 27 to hold the tool joint 25 stationary. The torque wrench assembly 15 can thus be used to make up and break out connections between the two pipe sections 23, 27.

A pipe spinner 29 and a spinner support plate 31 are mounted on top of a fluid powered lift 33, which is mounted on the carriage 11 for movement therewith. The pipe spinner 29 has clamping cylinders 35, which clamp onto the upper pipe section 23, so that the pipe section 23 can be rapidly spun in either direction. The clamping cylinders 35 of the pipe spinner 29 grip the upper pipe section 23 tightly enough to allow the pipe section 23 to be raised by the spinner 29 while the spinner 29 is rotating the pipe section 23.

The upper pipe section 23 may be part of a pipe stand consisting of two or more pipe sections. Although the weight of the stand is supported by the pipe spinner 29 during wrenching and spinning, a standard pipe elevator will remain closed on the pipe. If the pipe stand is raised by the elevator while the clamping cylinders 35 are closed on the pipe section 23, the pipe spinner 23 will also be raised relative to the spinner support plate 31.

Figure 2:
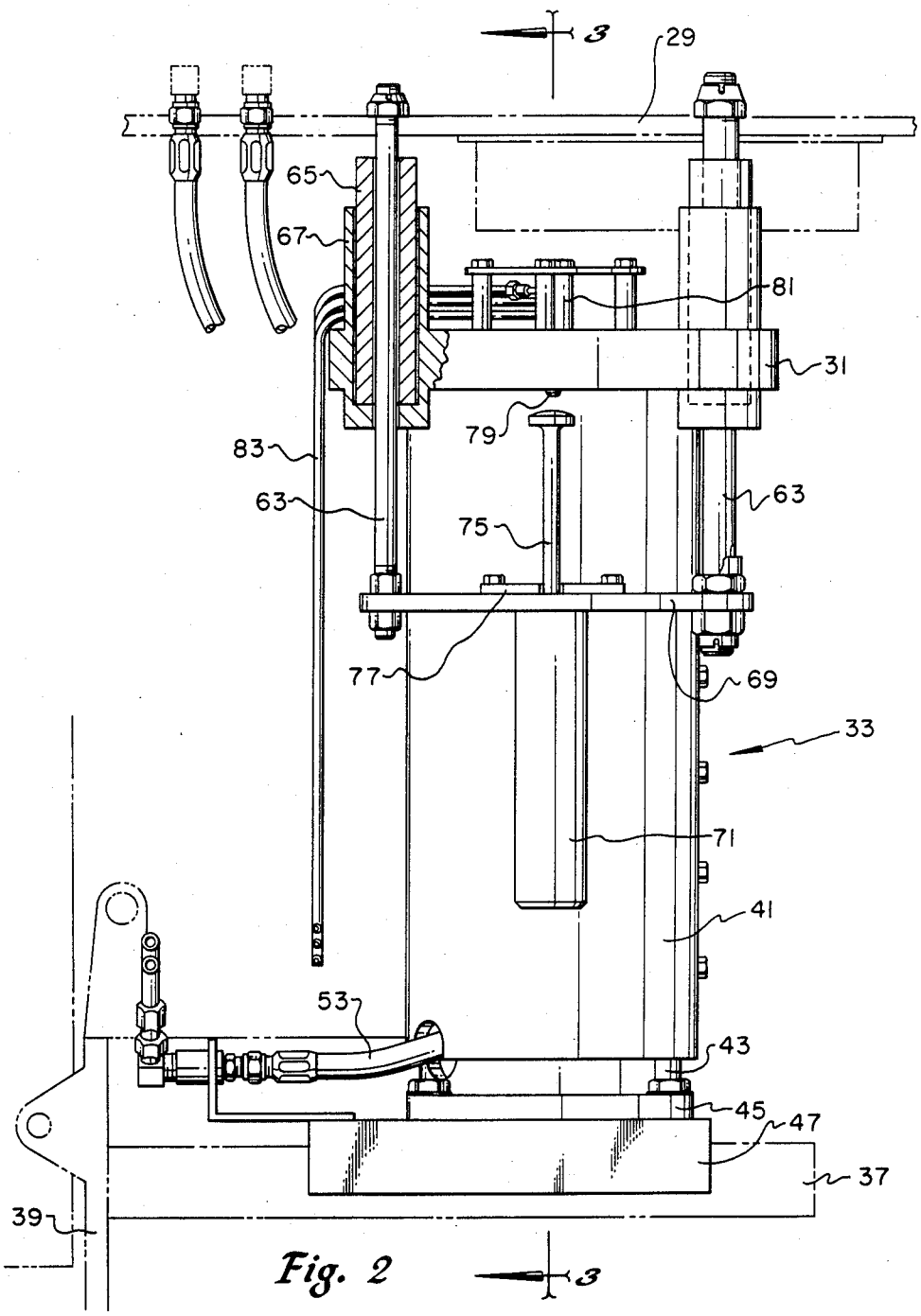
FIG. 2 is a close up side view, partially in section, of the piston and cylinder assembly of the invention.
Figure 3:
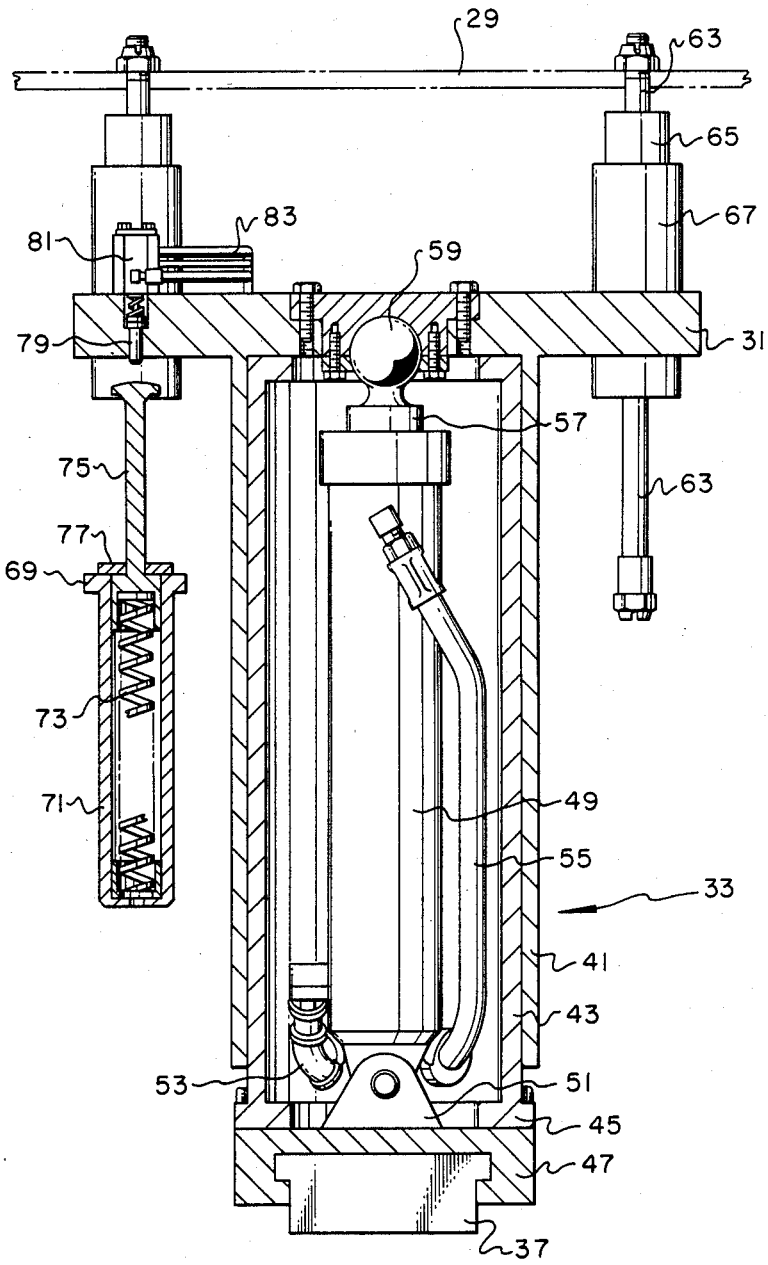
FIG. 3 is a sectional view along line 3—3 in FIG. 2.

FIGS. 2 and 3 illustrate the fluid powered lift 33 in greater detail. The hydraulic lift 33 is mounted on a spinner support portion 37 of a basket assembly 39 on the carriage 11. The lift 33 includes a movable cylinder 41 and a stationary cylinder 43. The stationary cylinder 43 is connected to a base 45, which is in turn connected to a stand jumping support slide 47. The stand jumping support slide 47 is mounted on the spinner support portion 37 of the basket assembly 39.

A piston and cylinder assembly 49 is secured to a clevis 51, which is attached to the stand jumping support slide 47. Hydraulic or pneumatic power is supplied to the lower end of the piston and cylinder assembly 49 through a hose 53, or to the upper end of the piston and cylinder assembly 49 through a second hose 55. The upper end of the piston rod 57 has a ball section 59, which is connected to the spinner support plate 31. The piston and cylinder assembly 49 is thus a power means for raising and lowering the spinner 29 and the spinner support plate 31 vertical relative to the carriage 11.

The pipe spinner 29 is connected to the spinner support plate 31 by connection means which consists of a plurality of rods 63, stabilizer bushings 65, and stabilizer sleeves 67. The piston and cylinder assembly 49 is thus a power means for raising and lowering the spinner 29 relative to the carriage 11. The connection means allows a certain amount of lateral float in the pipe spinner 29, so that the spinner 29 can operate properly. The connection means also allows a limited amount of vertical movement of the spinner 29 relative to the spinner support plate 31.

Two of the connecting rods 63 extend downward through the spinner support plate 31 to a horizontal bar 69. A cylindrical override housing 71 extends downward from the horizontal bar 69 between the two connecting rods 63. The override housing 71 houses a coil spring 73, and a push rod 75 extends upward from the override housing 71 through a push rod retaining plate 77. The spring 73 biases the push rod 75 upward.

A pin actuator 79 is located in the spinner support plate 31 directly above the push rod 75. When the spinner 29 is raised a minimum distance vertically, relative to the spinner support plate 31, the push rod 75 will contact the pin actuator 79. The pin actuator 79 then actuates a pilot valve 81. The pilot valve 81 is linked by a plurality of fluid line 83 to the spinner 29, to automatically open the clamping cylinders 35 whenever the push rod 75 contacts the actuator 79. The push rod 75, the actuator 79, and the pilot valve 81 are thus a means for automatically opening the clamping cylinders 35 whenever the spinner 29 is moved upward relative to the lift 33.

In operation, whenever a pipe connection is to be disconnected, the upper wrench 17 is connected to the tool joint 21 of the upper pipe section 23, and the lower wrench 19 is connected to the tool joint 25 of the lower pipe section 27. The torque wrench 15 is actuated to break the connection between the tool joints 21, 25. The upper wrench 17 is then unclamped, and the clamping cylinders 35 of the pipe spinner 29 are closed onto the upper pipe section 23. Fluid pressure is applied to the lower end of the piston and cylinder assembly 49 through a hose 53, thereby exerting an upward force on the pipe spinner 29. The pipe spinner 29 is then actuated to spin the upper pipe section 23, to unthread the connection between the tool joints 21, 25. When the connection between the tool joints 21, 25 has been completely unthreaded, the upward force on the pipe spinner 29 jumps the upper pipe section 23 upward, so that the upper tool joint 21 is raised completely out of the lower tool joint 25.

If the pipe stand is then raised by the elevator, the pipe spinner 29 is forced upward relative to the spinner support plate 31. The push rod 75 on the spinner 29 contacts the pin actuator 79 on the spinner support plate 31, and actuates the pilot valve 81. The clamping cylinders 35 of the pipe spinner 29 automatically open and release the upper pipe section 23. The elevator can then move the pipe stand to the storage area.

The well tool of the invention may also be used during a stabbing operation. First, the carriage 11 is moved into position, and the lower wrench 19 is connected to the tool joint 25 on the lower pipe section 27. The piston and cylinder assembly 49 is then actuated to raise the spinner 29 to its uppermost position. The upper pipe section 23 is then inserted into the spinner 29 and the clamping cylinders 35 are closed. Fluid pressure is applied to the upper end of the piston and cylinder assembly 49 through a hose 55, and the pipe spinner 29 lowers the upper pipe section 23. The upper tool joint 21 is thus carefully and automatically stabbed into the lower tool joint 25.

The well tool of the invention has several advantages over the prior art. The invention allows the upper pipe section 23, and the rest of the pipe stand, to be jumped out of the threaded connection. Stands of drill pipe, or of drill collars weighing 20,000 pounds or more, can be jumped out, even in situations where the jumping out capability of the standard hook is insufficient. The invention also provides for the spinner 29 to automatically release the drill pipe when the stand of pipe is raised by the pipe elevator.

While the invention has been shown in only one of its forms, it should be apparent to those skilled in the art that it is not so limited, but is susceptible to various changes and modifications without departing from the spirit thereof.

We claim:

1. A well tool, comprising:

a movable carriage;

a torque wrench assembly, mounted on the carriage for movement therewith, and for applying torque to make up and break out connections between two pipe sections;

a spinner, mounted on the carriage for movement therewith, and having clamping cylinders for spinning one pipe section relative to the other;

power means for raising and lowering the spinner relative to the carriage; and means for automatically opening the clamping cylinders of the spinner whenever the spinner is moved by external forces to a selected position relative to the power means.

2. A well tool, comprising:

a movable carriage;

a torque wrench assembly, mounted on the carriage for movement therewith, and for applying torque to make up and break out connections between upper and lower pipe sections;

a spinner, mounted on the carriage for movement therewith, and having clamping cylinders for spinning the upper pipe section relative to the lower pipe section;

power means for raising and lowering the spinner relative to the carriage; and means for automatically opening the clamping cylinders of the spinner, whenever the upper pipe section is raised and causes the spinner to move upward relative to the power means.

3. A well tool, comprising:

a movable carriage;

a torque wrench assembly, mounted on the carriage for movement therewith, and for applying torque to make up and break out connections between upper and lower pipe sections;

a spinner, mounted on the carriage for movement therewith, and having clamping cylinders for spinning the upper pipe section relative to the lower pipe section;

power means for raising and lowering the spinner relative to the carriage; and a push rod, connected to the spinner for movement therewith;

an actuator, mounted on the power means, for contact with the push rod whenever the upper pipe section is raised and causes the spinner to be raised relative to the power means; and a pilot valve, mounted on the power means, for automatically opening the clamping cylinders of the spinner whenever the push rod contacts the actuator.

4. A well tool, comprising:

a movable carriage;

a torque wrench assembly, mounted on the carriage for movement therewith, and for applying torque to make up and break out connections between upper and lower pipe sections;

a hydraulic piston and cylinder assembly mounted on the carriage;

a spinner support plate, mounted on the hydraulic cylinder and piston assembly, for vertical movement relative to the carriage;

a spinner, having clamping cylinders for spinning the upper pipe section relative to the lower pipe section;

connection means for connecting the spinner to the spinner support plate and for allowing limited vertical movement of the spinner relative to the spinner support plate; and means for automatically opening the clamping cylinders of the spinner, whenever the upper pipe section is raised and causes the spinner to move upward relative to the spinner support plate.

5. A well tool, comprising:

a movable carriage;

a torque wrench assembly, mounted on the carriage for movement therewith, and for applying torque to make up and break out connections between upper and lower pipe sections;

a hydraulic piston and cylinder assembly mounted on the carriage;

a spinner support plate, mounted on the hydraulic cylinder and piston assembly, for vertical movement relative to the carriage;

a spinner, having clamping cylinders for spinning the upper pipe section relative to the lower pipe section;

connection means for connecting the spinner to the spinner support plate and for allowing limited vertical movement of the spinner relative to the spinner support plate;

a push rod, connected to the spinner for movement therewith;

an actuator, mounted on the spinner support plate, for contact with the push rod whenever the upper pipe section is raised and causes the spinner to be raised relative to the spinner support plate; and a pilot valve, mounted on the spinner support plate, for automatically opening the clamping cylinders of the spinner whenever the push rod contacts the actuator.

6. A well tool, comprising:

a movable carriage;

a torque wrench assembly, mounted on the carriage for movement therewith, and for applying torque to make up and break out connections between upper and lower pipe sections;

a hydraulic piston and cylinder assembly mounted on the carriage;

a spinner support plate, mounted on the hydraulic cylinder and piston assembly, for vertical movement relative to the carriage;

a spinner, having clamping cylinders for spinning the upper pipe section relative to the lower pipe section;

connection means for connecting the spinner to the spinner support plate and for allowing limited vertical movement of the spinner relative to the spinner support plate, and for allowing limited horizontal movement of the spinner relative to the carriage;

a push rod, connected to the spinner for movement therewith;

an actuator, mounted on the spinner support plate, for contact with the push rod whenever the upper pipe section is raised and causes the spinner to be raised relative to the spinner support plate; and a pilot valve, mounted on the spinner support plate, for automatically opening the clamping cylinders of the spinner whenever the push rod contacts the actuator.

7. A method of disconnecting connections in a well pipe, comprising the steps of:

connecting an upper torque wrench to a tool joint on an upper pipe section;

connecting a lower torque wrench to a tool joint on a lower pipe section;

actuating the upper and lower torque wrenches to break the connection between the tool joints;

unclamping the upper torque wrench from the tool joint on the upper pipe section;

closing clamping cylinders of a pipe spinner onto the upper pipe section;

exerting an upward force on the pipe spinner;

actuating the pipe spinner to spin the upper pipe section to unthread the connection between the tool joints, while the upward force is being exerted on the pipe spinner; and raising the upper pipe section with an elevator to automatically open the clamping cylinders of the pipe spinner.

* * * * *